United States Patent [19]

Begun

[11] 4,161,345

[45] Jul. 17, 1979

[54] SUPPORTING FRAME FOR FURNITURE

[75] Inventor: James A. Begun, Montpelier, Vt.

[73] Assignee: Howard W. Martin, Montpelier, Vt.; a part interest

[21] Appl. No.: 897,337

[22] Filed: Apr. 18, 1978

[51] Int. Cl.[2] ..... A47B 91/08

[52] U.S. Cl. ..... 312/253; 248/188.1; 312/198; 312/209

[58] Field of Search ..... 312/209, 243, 253, 198, 312/239; 248/188.1; 108/64

[56] References Cited

U.S. PATENT DOCUMENTS

| | | | |
|---|---|---|---|
| 2,643,167 | 6/1953 | Wade | 312/239 |
| 2,710,241 | 6/1955 | Lieberman | 248/188.1 |
| 2,755,155 | 7/1956 | Luss | 312/198 |
| 3,010,774 | 11/1961 | Doherty | 312/209 |
| 3,455,620 | 7/1969 | Coburn | 312/257 R |

*Primary Examiner*—Mervin Stein
*Assistant Examiner*—Alexander Grosz
*Attorney, Agent, or Firm*—Eric Y. Munson

[57] ABSTRACT

A frame for supporting a plurality of interchangeable units of office furniture. The frame both supports the furniture in an upright direction, prevents the furniture from sliding in a horizontal direction and is concealed from view when the furniture is mounted on it. The arrangement of the furniture can be varied by interchanging the positions of the various separate units of furniture carried along the frame. The frame itself can also be advantageously utilized to carry additional equipment pivotably mounted thereon and to provide means for storing such additional equipment when not in use. Because the frame rigidifies the furniture structure mounted thereon, lightweight and inexpensive furniture can be used.

12 Claims, 1 Drawing Figure

SUPPORTING FRAME FOR FURNITURE

FIELD OF THE INVENTION

The invention relates to office furniture, and more specifically to a frame for supporting and mounting a plurality of interchangeable units of office furniture and equipment used in connection with such furniture.

BACKGROUND OF THE INVENTION

Many professionals, such as dentists, optometrists, chemists and other scientifically orientated persons, are required, by the nature of their professions, to spend most of their working time in a confined work area. To more efficiently utilize their time, it is important to arrange their offices such that any working material or equipment that they might need will be readily accessible to them.

Arranging furniture to produce an efficiently utilized work area is known to those skilled in the art. For example, U.S. Pat. No. 4,013,328 discloses and claims an arrangement of dental equipment and furniture which enables a dentist to work more effectively by using his office more efficiently.

U.S. Pat. Nos. 3,922,788 and 3,010,774 also disclose arrangements of office furniture which enable dentists to work more efficiently.

U.S. Pat. No. 2,334,776 further discloses an arrangement of furniture for a chemistry laboratory which more effectively utilizes a limited work space area.

However, it is not believed that any of the above cited art discloses or teaches a concealed frame which is used to support and mount a plurality of individual units of furniture such that the arrangement of the furniture may be varied by interchanging the position of the units on the frame.

It is the object of this invention to provide such a frame.

SUMMARY OF THE INVENTION

The invention provides a novel frame support for an arrangement of office furniture to provide an efficient work area.

The frame comprises a plurality of segments or members joined together in such a manner to define the outline of any desired arrangement of office furniture. Two associated supporting pillars are positioned contiguous with two ends of the frame. These pillars, in addition to their supporting function, can further be utilized to carry and store various additional equipment.

Furniture which is mounted on the frame structure defines a work area. When in mounted position, the furniture covers the frame and thus conceals it from view.

In the preferred embodiment of the invention, to be hereinafter described, the members of the frame are segments of approximately equal length, each of which supports an associated unit of furniture. The units of furniture are removably mounted on the frame. When all such furniture units are mounted on the frame, the outward appearance of a single structure is generated.

The advantages provided by the frame are as follows:

The frame serves to rigidify and support the furniture units thus allowing the use of lightweight and inexpensive furniture.

The frame provides the owner with means for interchanging the positions of the individual units and thus rearranging the arrangement of the room yet, at the same time, generating the appearance of being a single integral unit of furniture. In the event that the original arrangement of the office furniture proves unsatisfactory after it is installed, the units may be readily rearranged on the frame. This is virtually impossible to accomplish with an arrangement of furniture that is, in fact, one integral unit, such as shown in some of the prior art.

The frame reduces the cost of the installation of the furniture since only the frame, and not the furniture units themselves, are affixed to the floor.

The frame can be used to provide cabinet space and to support equipment which can be pivoted into and out of the cabinet space so provided.

The frame is concealed from view when the furniture units are mounted thereon, thus adding to the aesthetic appearance of the configuration.

The above described features of the present invention will become clear when described in detail in conjunction with the following drawing.

DESCRIPTION OF THE PREFERRED EMBODIMENT

Figure 1:
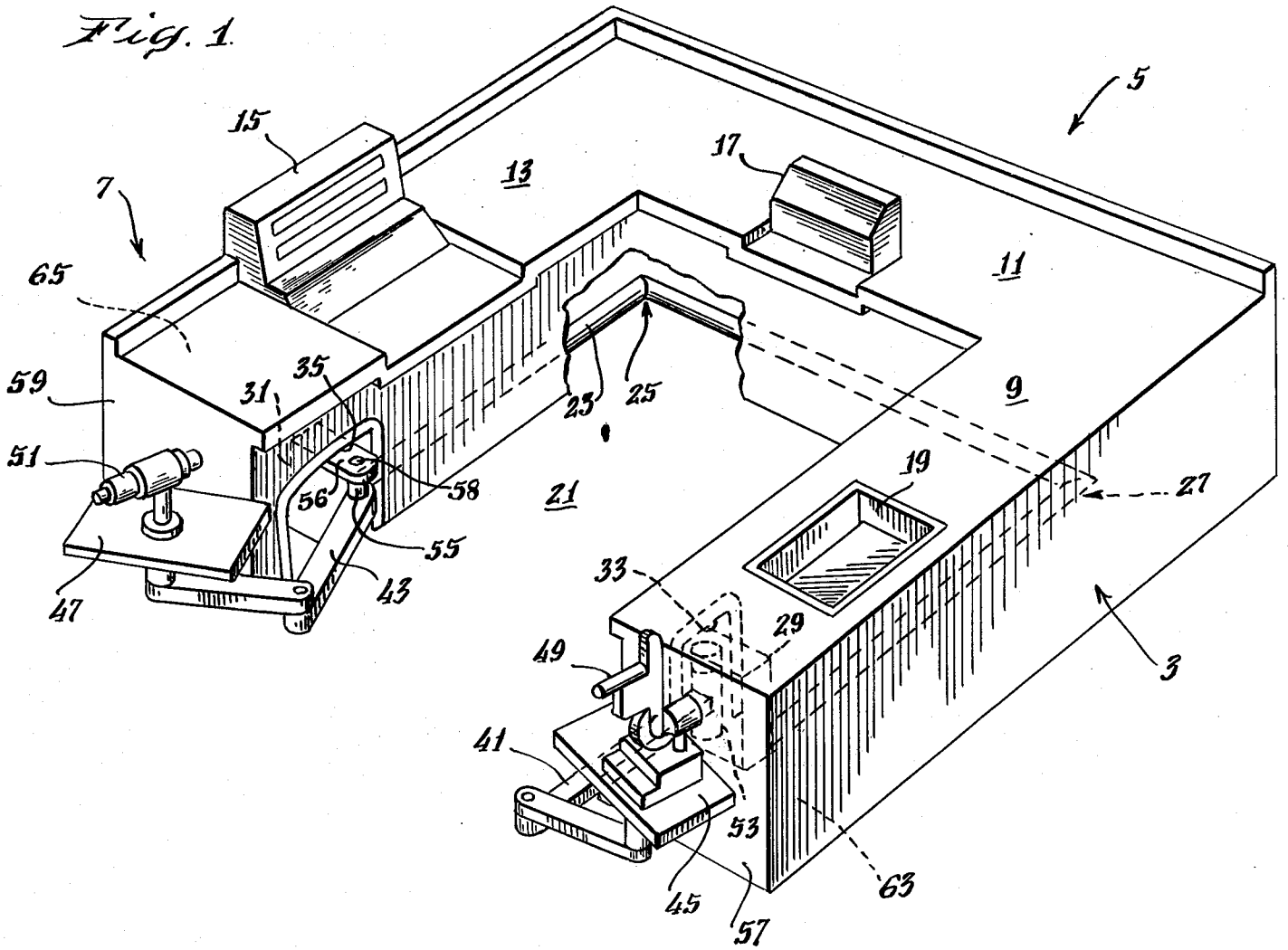
FIG. 1 illustrates a perspective view of the frame used in an optometrist's office. The frame is shown in phantom.

Referring to FIG. 1 of the drawing, one embodiment of the frame is shown supporting a plurality of furniture units.

Although this embodiment and the following discussion relate primarily to a "U" shaped furniture arrangement for an optometrist's office, the invention is not so limited in application and scope. It will become evident that the disclosed frame can be advantageously used for supporting any desired configuration of furniture in any type of office.

According to the invention, FIG. 1 generally shows a "U" shaped arrangement of office furniture indicated as 1. In this embodiment, three individual units of furniture are indicated by numerals 3, 5 and 7. Each of the three units shown in this embodiment are of approximately equal length.

The top surfaces associated with each of the units 3, 5 and 7, indicated by numerals 9, 11 and 13 respectively, provide support for various equipment positioned and affixed thereon. For example, in the present embodiment, surface 13 carries the controls 15, surface 11 carries element 17, and surface 9 carries the sink 19.

The furniture units 3, 5 and 7 are so arranged to define a work area indicated generally by numeral 21. A seat (not shown) can be positioned within this defined work space in any convenient location to accommodate a patient during an eye examination. As can already be seen and will be further developed below, this arrangement of office furniture provides the examining optometrist with ready access to any equipment he may need during the course of the examination.

The frame support used in this particular embodiment is indicated by numeral 23. It comprises three different segments each of which are associated with one of the individual furniture units. Each segment has a length about equivalent to the length of its associated furniture unit. In the embodiment of the invention shown by FIG. 1, the three segments comprising the frame 23 are shown as rod-shaped members.

The three rod-shaped frame segments are joined together at their points of intersection, indicated by arrows 25 and 27. In the alternative, the frame itself can be manufactured as one integral piece, thus eliminating the necessity of individually joining the separate segments together. In the embodiment of the invention shown by FIG. 1, the rod-shaped members define a generally squared "U shape" configuration.

The frame structure is carried on the floor of the office (not shown) and can be affixed thereto by any of a number of commonly known methods, as for example, by bolting. As seen in FIG. 1, the arrangement of configuration of the rod-shaped members, of the frame 23 corresponds to the arrangement of configuration of the units of furniture positioned thereabove.

The frame 23 terminates in furniture supporting stanchions 29 and 31. In the embodiment shown by FIG. 1, the stanchions are shown as rectangularly shaped blocks. These supporting stanchions are housed within openings 35 and 33, respectively. These openings are cut from the walls of furniture units 3 and 7.

The supporting stanchions 29 and 31 abut upwardly against their respective associated furniture units such that these units rest upon the top portion of the stanchions. Thus, the stanchions tend to support and rigidify the furniture structure resting thereupon.

In the present embodiment, the stanchions also advantageously serve a secondary function, namely, supporting additional equipment in addition to supporting the furniture units themselves.

The stanchions 29 and 31 each carry associated vertical posts, indicated respectively as 53 and 55. In the embodiment of the invention shown by FIG. 1, the vertical post 55 is mounted to an extension 56 of the block shaped furniture supporting stanchion 31 by insertion thereof through an opening 58 defined in the extension. The vertical posts each carry associated armature means, indicated respectively as 43 and 41, which are pivotably mounted thereon. Armature means 43 and 41 carry trays 47 and 45, respectively. These trays provide a flat surface for carrying additional equipment 49 and 51.

Armature means 41 and 43 can be moved in a vertical direction on vertical posts 53 and 55. Thus, the height of equipment 51 and 49 is adjustable. The armatures are maintained at a desired height on the vertical posts by the use of any of a variety of retaining means known to the art, such as adjustable springs or clamps (not shown).

When either equipment 49 and 51 is not in use, it can conveniently be stored out of the way within the hollow compartments defined between the supporting stanchions and the end walls 57 and 59 of furniture units 3 and 7. These compartments, which are indicated by numerals 63 and 65 on FIG. 1, provide chambers from which equipment 47 and 49 can be pivoted into and out of via armature means 43 and 41. Thus, the equipment is readily accessible to the optometrist, yet will not interfere with him or occupy space within the work area 21 during times when it is not needed.

Although the furniture is comprised of three separate units, its general appearance is that of a single piece. This integral appearance is accomplished because the rod-shaped members comprising the frame are of such dimension that they maintain furniture unit 3 in a contiguously abutting relationship with furniture unit 5, and they simultaneously maintain furniture unit 7 in a contiguously abutting relationship with furniture unit 5.

The frame provides the added advantage of enabling the optometrist to easily rearrange his office by interchanging the positions of the various furniture units mounted on the frame. In the event that the original layout of the office proves to be not as efficient as the optometrist originally believed, he can conveniently switch the positions of the individual units to maximize efficiency.

In order to take advantage of this feature, all individual furniture units must be provided with openings on both sides of the unit to accommodate the supporting stanchions on the ends of the frame. Thus, regardless of where any particular furniture unit is mounted on the frame at any given time, there will always be an opening available to accommodate any one of the supporting stanchions, their associated armature means, and the equipment carried thereby. When a furniture unit is in such a position that one or both of the openings are not being used to accommodate a supporting stanchion, the opening or openings not being so utilized will be concealed by any suitable means, as, for example, a sliding panel door (not shown) which is capable of being received upwardly by the surfaces 9, 11 or 13, of the furniture thereabove.

It is readily apparent from FIG. 1 that when the furniture units are mounted on the frame, the entire frame, with the exception of the supporting stanchions, is concealed from view, thus enhancing the aesthetic appearance of the structure as a whole. In a slightly modified embodiment of the invention in which the supporting stanchions is not used to support equipment 49 and 51 or armature means 41 and 43, the furniture units will conceal all of the frame, including the supporting stanchions.

In addition to the aforementioned advantages provided by the invention, namely; a concealed frame which supports a plurality of furniture units, enables the separate units to give the total appearance of one integral unit, supports additional equipment which may be pivotably mounted thereon, and enables the owner to interchange the units; other advantageous features are also realized.

Firstly, the time and cost of installation of the office furniture is markedly reduced by the novel frame because it is only necessary to install the frame. Once installed, the furniture is easily mounted thereon. The furniture itself does not have to be affixed to the floor.

Secondly, because the frame serves to support and rigidify the furniture, lightweight, and thus inexpensive, furniture can be utilized.

Thirdly, the frame prevents the furniture mounted thereon from sliding horizontally along the floor but will maintain it in the position it is originally placed.

The frame can be prefabricated in advance to accommodate standard configurations of office furniture, or the frame can be custom made to fit any configuration of office furniture desired.

Furthermore, although the above description has been directed towards a frame for supporting a plurality of individual interchangeable units of furniture, the same advantages are obtained by utilizing the frame in conjunction with only a single integral piece of furniture.

It is evident that additional modifications of the invention which can be advantageously utilized will be apparent to those of ordinary skill in the art.

The description of the invention hereinabove provided is meant to be illustrative only and is not intended to restrict the scope of the invention, said scope being defined by the following claims and all equivalents thereto.

I claim:

1. A frame for defining a configuration for arranging and supporting furniture thereon, said frame including a plurality of rod-like members joined together to define a configuration corresponding to a desired arrangement of furniture, said configuration of said joined rod-like members having first and second end portions, said configuration of said joined rod-like members being carried by a supporting floor, first and second furniture supporting stanchions affixed to said first and second end portions, respectively, said first and second furniture supporting stanchions being of sufficient height relative to the height of said furniture such that said furniture rests upon the top of said supporting stanchions when said furniture is positioned above said plurality of joined rod-like members comprising said frame, wherein said supporting stanchions support said furniture mounted thereon, said furniture concealing said plurality of joined rod-like members when said furniture is positioned thereabove, armature means for supporting additional equipment, said armature means being pivotably mounted to at least one of said furniture supporting stanchions such that said additional equipment can be pivoted into and out of predetermined positions, said furniture supported by said supporting stanchions and said supporting stanchions defining at least one compartment therebetween for storing said additional equipment, said armature means and said additional equipment carried thereon being pivotable into and out of said defined compartment.

2. A frame as claimed in claim 1 wherein said plurality of rod-like members are bolted to said supporting floor.

3. A frame as claimed in claim 1 wherein said first and second supporting stanchions are blocks.

4. A frame as claimed in claim 3 wherein said blocks are rectangularly shaped.

5. A frame as claimed in claim 1 wherein said configuration of said plurality of joined rod-like members prevents said furniture from sliding along said supporting floor.

6. A frame as claimed in claim 1 wherein each of said plurality of rod-like members corresponds to a separate unit of said furniture.

7. A frame as claimed in claim 6 wherein each of said plurality of rod-like members is of sufficient length such that said corresponding separate units of furniture are maintained in a contiguously abutting relationship, whereby said separate units of furniture project the appearance of a single integral structure.

8. A frame as claimed in claim 6 wherein separate units of furniture are interchangeably positioned above-said plurality of joined rod-like members.

9. A frame as claimed in claim 1 wherein said configuration of said rod-like members are integrally joined to each other.

10. A frame as claimed in claim 1 wherein at least one of said furniture supporting stanchions includes a member extending therefrom, said extending member defining an opening thereon, a vertical post inserted through said opening in said extending member, said armature means being pivotably mounted to said vertical post, whereby said armature means are mounted to at least one of said furniture supporting stanchions.

11. A frame as claimed in claim 10 wherein said armature means is vertically movable along said vertical post, and means for maintaining said armature means at a desired elevation on said vertical posts, whereby the height of said additional equipment carried by said armature means is adjustable.

12. A frame as claimed in claim 11 wherein said means for maintaining said armature means at a desired position includes a clamp.

* * * * *